US006397885B1

(12) United States Patent
Golden et al.

(10) Patent No.: US 6,397,885 B1
(45) Date of Patent: Jun. 4, 2002

(54) VACUUM CONTROL APPARATUS FOR MAINTAINING THE OPERATING CONDITION OF A VACUUM RESPONSIVE DEVICE DURING LOSS AND RESUMPTION OF POWER

(75) Inventors: Michael J. Golden, Sterling Hts.; Kenneth Dellach, Shelby Township, both of MI (US)

(73) Assignee: Norgren Automotive, Inc., Clinton Township, MI (US)

( * ) Notice: Subject to any disclaimer, the term of this patent is extended or adjusted under 35 U.S.C. 154(b) by 0 days.

(21) Appl. No.: 09/777,740

(22) Filed: Feb. 6, 2001

(51) Int. Cl.[7] ..... F04F 5/52

(52) U.S. Cl. ..... 137/565.22; 137/565.23; 294/64.2; 417/187

(58) Field of Search ..... 137/14, 565.22, 137/565.23; 294/64.2; 417/187

(56) References Cited

U.S. PATENT DOCUMENTS 5,188,411 A 2/1993 Golden
5,201,560 A 4/1993 Golden
5,277,468 A 1/1994 Blatt

*Primary Examiner*—Gerald A. Michalsky
(74) *Attorney, Agent, or Firm*—Young & Basile, P.C.

(57) ABSTRACT

A vacuum control apparatus for generating and controlling the source of vacuum produced from a source of pressurized air in communication with at least one vacuum responsive device wherein the vacuum control apparatus maintains the operating conditions of the system during the loss and resumption of power. The vacuum control apparatus provides at least one venturi for creating a vacuum through a flow of pressurized air. A first valve train selectively provides a flow of pressurized air from a pressurized air source to the vacuum creating means. A second valve train communicates with the pressurized air source to selectively provide a flow of pressurized air to the vacuum responsive device. A last function valve communicates with the first and second valve trains and a pressurized air source to maintain the operating condition of the vacuum control apparatus during the loss and resumption of power to the first and second valve trains.

18 Claims, 6 Drawing Sheets

POWER ON - VACUUM MODE

POWER OFF - BLOW-OFF MODE

VACUUM CONTROL APPARATUS FOR MAINTAINING THE OPERATING CONDITION OF A VACUUM RESPONSIVE DEVICE DURING LOSS AND RESUMPTION OF POWER

FIELD OF THE INVENTION

The present invention relates to a vacuum control apparatus for generating and controlling the source of vacuum from a source of pressurized air to a vacuum responsive device, and more particularly, a vacuum control apparatus that maintains the operating condition of a vacuum responsive device during the loss and resumption of power.

BACKGROUND OF THE INVENTION

Vacuum operated work holding devices are commonly employed as workpiece gripping elements to engage and transport workpieces in a manufacturing operation, to load and unload sheet metal parts into and from a die, or to carry a part, such as an automobile windshield, to the vehicle in which it is to be installed. Such vacuum operated work holding devices employ a control apparatus which uses a venturi passageway and a body which is connected to a source of pressurized air. Airflow through the venturi passageway induces a sub-atmospheric pressure in the throat of the venturi and in a passage connecting the venturi throat to the interior of a vacuum operated work holding device, such as a vacuum cup. This sub-atmospheric pressure induces vacuum within the cup when the cup engages a workpiece surface.

Further advancements of the vacuum control apparatus have led to designs which generate and control a source of vacuum produced from a source of pressurized air that is positioned remote from the vacuum operated work holding device, thereby allowing for a single remote control system to control a plurality of vacuum operated work holding devices. These designs provide the distinct advantage of allowing a plurality of vacuum operated work holding devices to be attached to a single controller. This provides further flexibility as the vacuum flow rate available to the vacuum operated work holding devices can be increased by increasing the number of venturis engaged in the sub-atmospheric pressure generating system.

Due to the fact that these vacuum operated work holding devices are commonly utilized in an industrial environment, the power supplied to these devices is often interrupted. For example, such devices are often provided with emergency stops wherein an operator of the device may actuate the emergency stop to cut the power to the device. When this occurs, it is desirous to have the vacuum operated work holding device, such as a vacuum cup, maintain its vacuum so that any workpiece that is being held by the vacuum cup will be maintained and held by the vacuum cup. On the other hand, if the vacuum cups are not engaging a workpiece when the power is disengaged, then it is desirous to have the air supply disengage so that pressurized air is conserved.

Possible solutions to these problems include electrically wiring the vacuum operated work holding device prior to the emergency stop so that power will be maintained to the vacuum control apparatus even after power has been disengaged to the remainder of the system. This solution is typically not desirable since most operators do not wish for any power to be linked to the system in an emergency stop condition.

Another possible solution is to add a power failure override circuit to the vacuum operated work holding device so that the vacuum generating device runs at a maximum vacuum condition when the power is disengaged. The disadvantage with this system is that the vacuum will continue to run regardless of whether the vacuum cups are currently engaging a workpiece. This of course, fails to conserve pressurized air and fails to reduce the level of unnecessary noise caused by the continuous blowing of pressurized air.

It is desirable to provide a vacuum control apparatus that will maintain the operating condition of a vacuum responsive device during the loss and resumption of power.

SUMMARY OF THE INVENTION

The present invention overcomes the above-noted disadvantages by providing an improved vacuum control apparatus for generating and controlling the source of vacuum produced from a source of pressurized air in communication with at least one vacuum responsive device wherein the vacuum control apparatus maintains the operating conditions of the system during the loss and resumption of power. The apparatus provides means for creating vacuum through a flow of pressurized air wherein the vacuum creating means communicates vacuum to the vacuum responsive device. A first valving means selectively provides a flow of pressurized air from the pressurized air source to the vacuum creating means. A second valving means selectively provides a flow of pressurized air from the pressurized air source to the vacuum responsive device. The apparatus also provides means for maintaining the operating condition of the vacuum responsive device created by the selective positioning of the first and second valving means during the loss and resumption of power to the first and second valving means.

The vacuum creating means may consist of at least one venturi for generating sub-atmospheric pressure in response to a flow of pressurized air. More venturis may be added to the apparatus to increase the amount of vacuum applied to a vacuum responsive device or to increase the number of vacuum responsive devices utilized.

The first valving means provides a first valve train having a vacuum solenoid operated valve that is communicatable with the pressurized air source and actuatable between an open position, wherein pressurized air flows through the vacuum solenoid operated valve from the pressurized air source, and a closed position, wherein pressurized air from the pressurized air source is blocked from flowing through the vacuum solenoid operated valve. An external power solenoid operated valve communicates with the vacuum solenoid operated valve and is actuated in a first position, wherein pressurized air from the vacuum solenoid operated valve flows through the external power solenoid operated valve, and deactuated in a second position, wherein pressurized air from the vacuum solenoid operated valve is blocked from passing through the external power solenoid operated valve. A vacuum pilot poppet valve communicates with the external power solenoid operated valve and is moveable between an open position, wherein pressurized air from the pressurized air source flows through the vacuum pilot poppet valve, and a closed position, wherein pressurized air is blocked from flowing through the vacuum pilot poppet valve. A vacuum poppet valve communicates with the vacuum pilot poppet valve and is communicatable with the pressurized air source. The vacuum poppet valve is movable between an open position, wherein pressurized air from the pressurized air source flows through the vacuum poppet valve to the vacuum responsive device, and a closed position, wherein pressurized air is blocked from flowing through the vacuum poppet valve.

The second valving means provides a second valve train having a blow-off solenoid operated valve communicatable with the pressurized air source and actuatable between an open position, wherein pressurized air flows through the blow-off solenoid operated valve from the pressurized air source, and a closed position, wherein pressurized air is blocked from passing through the blow-off solenoid operated valve. A blow-off poppet valve communicates with the blow-off solenoid operated valve and is communicatable with the vacuum responsive device. The blow-off poppet valve is movable between an open position, wherein pressurized air from the pressurized air source flows through the blow-off poppet valve to the vacuum responsive device, and a closed position, wherein pressurized air is blocked from flowing through the blow-off poppet valve.

The means for maintaining the operating condition of the vacuum responsive device includes a last function valve in communication with the first and second valving means. The last function valve is movable between an open position, wherein pressurized air from the vacuum solenoid operated valve moves the last function valve to an open position so that pressurized air from the pressurized air source may flow to the external power solenoid operated valve, and a closed position, wherein pressurized air from the blow-off solenoid operated valve moves the last function valve to a closed position so that pressurized air from the pressurized air source cannot flow through the last function valve. When power is lost to the first and second valving means and the vacuum control apparatus is in the vacuum mode, the external power solenoid operated valve is deactuated to the second position, wherein pressurized air from the last function valve flows through the external power solenoid operated valve and is ultimately routed to the vacuum generating means to maintain vacuum during the loss and resumption of power to the first and second valving means. If power is lost to the first and second valving means during a blow-off condition, the last function valve remains in the closed position thereby preventing pressurized air from flowing to the vacuum generating means during the loss and resumption of power.

A vacuum sensing means is held in communication with the vacuum creating means and the vacuum responsive device. The vacuum sensing means sends a signal to a controlling means indicating the level of vacuum after the resumption of power. If the vacuum level is above a predetermined level, then the controlling means actuates the first valving means into a power-on vacuum mode. If the vacuum level is below the predetermined level, then the controlling means remains idle.

BRIEF DESCRIPTION OF THE DRAWINGS

The present invention will be more fully understood by reference to the following detailed description of the preferred embodiments of the present invention when read in conjunction with the accompanying drawings, in which like reference numerals refer to like parts throughout the various views.

DESCRIPTION OF THE PREFERRED EMBODIMENTS

Figure 1:
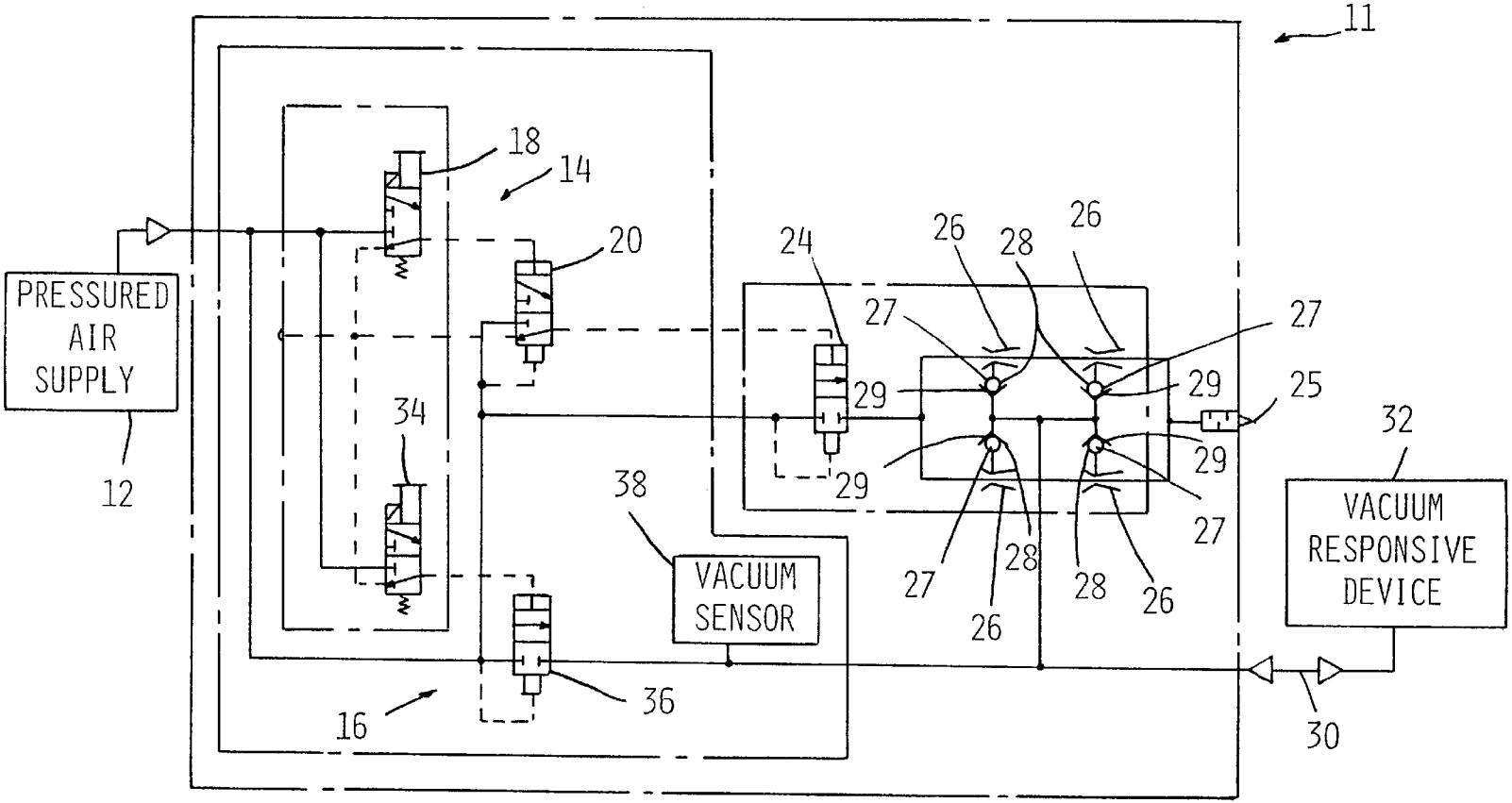
FIG. 1 PRIOR ART
FIG. 1 is a prior art schematic diagram of a vacuum control apparatus.

FIG. 1 shows a schematic diagram of a prior art vacuum control apparatus 11. The prior art schematic diagram in FIG. 1 is shown in a power-off position and is utilized with conventional manifolds, valving, and vacuum cup hardware. As seen in FIG. 1, a pressurized air source 12 provides a supply line of pressurized air throughout the prior art vacuum control apparatus 11. The pressurized air supply 12 is in communication with a vacuum valve train 14 and a blow-off valve train 16. The vacuum valve train 14 selectively provides a pressurized air to a plurality of venturis 26 to create a vacuum. The vacuum is supplied to a vacuum responsive device 32 for engaging a workpiece (not shown). The blow-off valve train 16 selectively provides pressurized air to the vacuum responsive device 32 to release the workpiece from the vacuum responsive device 32. (It should be noted that the drafter has referred throughout this document to a valve as being "open" when pressurized air can flow through the valve, and as being "closed" when pressurized air is blocked from flowing through the valve. This may be inconsistent with the nomenclature utilized in the pneumatics art.)

To provide pressurized air to the venturis 26, the vacuum valve train 14 includes a vacuum solenoid operated valve 18 that is electrically actuatable between an open position and a closed position. When the vacuum solenoid operated valve 18 is actuated in the open position, a flow of pressurized air from the pressurized air supply 12 is allowed to flow through the vacuum solenoid operated valve 18. When the vacuum solenoid operated valve 18 is deactuated (as shown in FIG. 1), the vacuum solenoid operated valve 18 is closed, and pressurized air is blocked from passing through the vacuum solenoid operated valve 18.

When the vacuum solenoid operated valve 18 is in the open position, the flow of pressurized air from the pressurized air source 12 is directed to a vacuum pilot poppet valve 20. The vacuum pilot poppet valve 20 is an air-actuated valve that may be moved between an open and closed position. When the vacuum pilot poppet valve 20 receives a flow of pressurized air from the vacuum solenoid operated valve 18, the vacuum pilot poppet valve 20 moves to the open position, and pressurized air from the pressurized air source 12 flows through the vacuum pilot poppet valve 20. The vacuum pilot poppet valve 20 is also in communication with the pressurized air source 12 such that if the vacuum pilot poppet valve 20 does not receive a flow of pressurized air from the vacuum solenoid operated valve 18, then pressurized air from the pressurized air source 12 moves the vacuum pilot poppet valve 20 to the closed position (as shown in FIG. 1), and pressurized air from the pressurized air source 12 is blocked from passing through the vacuum pilot poppet valve 20.

To further direct pressurized air to the venturis 26, the vacuum pilot poppet valve 20 communicates with a vacuum poppet valve 24. The vacuum poppet valve 24 is an air actuated valve that is movable between an open position and a closed position. The vacuum poppet valve 24 is moved to the open position by a flow of pressurized air received from the vacuum pilot poppet valve 20. When the vacuum poppet valve 24 is in the open position, pressurized air from the pressurized air source 12 is allowed to flow to the venturis 26. When a flow of pressurized air is not provided to the vacuum poppet valve 24 from the vacuum pilot poppet valve 20, then a flow of pressurized air from the pressurized air source 12 moves the vacuum poppet valve 24 to a closed position, (as shown in FIG. 1) and pressurized air from the pressurized air source 12 is blocked from flowing through the vacuum poppet valve 24 to the venturis 26.

The venturis 26 are conventional in that they generate vacuum through a flow of pressurized air passing over a small inlet or orifice. Once the pressurized air passes through the venturis 26, the pressurized air exhausts to an exhaust port 25 provided downstream of the venturis 26. Check valves 28 are connected in series with the vacuum port output of each venturi 26 to isolate each venturi 26 from the other venturis in the stack. When vacuum is created through the use of pressurized air flowing through the venturis 26, a check ball or flapper 27 in the check valve 28 lifts to open the check valve 28 thus allowing vacuum to flow to the vacuum port 30. When the flow of pressurized air ceases, the check ball or flapper 27 in the check valve 28 seats on a valve seat 29 to close the check valve 28 and prevent atmospheric pressure from entering the vacuum supply line through the venturis 26. The supply line leading from the venturis 26 provides vacuum to a vacuum port 30 which is in communication with the vacuum responsive device 32.

To release a workpiece from the vacuum responsive device 32, the vacuum control apparatus 11 provides the blow-off valve train 16. The blow-off valve train 16 includes a blow-off solenoid operated valve 34 which is electrically actuatable between an open position and a closed position. The blow-off solenoid operated valve 34 communicates with the pressurized air source 12 so that when the blow-off solenoid operated valve 34 is actuated into the open position, pressurized air from the pressurized air source 12 flows through the blow-off solenoid operated valve 34. When the blow-off solenoid operated valve 34 is deactuated, the blow-off solenoid operated valve 34 moves to a closed position to block the flow of pressurized air through the blow-off solenoid actuated valve 34.

When the blow-off solenoid actuated valve 34 is actuated in the open position and pressurized air is allowed to flow through the blow-off solenoid operated valve 34, the pressurized air is directed to a blow-off poppet valve 36. The blow-off poppet valve 36 is an air actuated valve that is movable between an open position and a closed position. When the blow-off poppet valve 36 receives a flow of pressurized air from the blow-off solenoid operated valve 34, the blow-off poppet valve 36 moves to the open position, and pressurized air from the pressurized air source 12 flows through the blow-off poppet valve 36 to the vacuum port 30. When there is no flow of pressurized air to the blow-off poppet valve 36 from the blow-off solenoid operated valve 34, a flow of pressurized air from the pressurized air source 12 moves the blow-off poppet valve 36 to the closed position, and pressurized air is prevented from passing through the blow-off poppet valve 36 to the vacuum port 30. The prior art vacuum control apparatus 11 also provides a vacuum sensor 38 in communication with the vacuum port 30 to provide an indication as to the level of vacuum being supplied to the vacuum port 30.

FIGS. 2–6 show the schematic diagrams and the flow chart utilized in the vacuum control apparatus 10 of the present invention. The schematic diagrams are utilized with conventional manifolds, valving, and vacuum cup hardware. The controller functions not expressly defined in this document are incorporated by reference in U.S. Pat. No. 5,201,560. The vacuum control apparatus 10 of the present invention is unique and novel over the prior art vacuum control apparatus 11 in that the vacuum control apparatus 10 provides a means for maintaining the operating condition of the vacuum responsive device 32 during the loss and resumption of power to the vacuum control apparatus 10. In so doing, the vacuum control apparatus 10 utilizes the pressurized air source 12 to provide supply lines 13 of pressurized air to the vacuum control apparatus 10. A first valving means 40 provides a vacuum valve train 42 for selectively providing a flow of pressurized air from said pressurized air source 12 to a vacuum creating means 44 to create and supply vacuum to the vacuum responsive device 32. The vacuum responsive device 32 utilizes the vacuum to engage and hold a workpiece (not shown). A second valving means 46 utilizes the blow-off valve train 16 to selectively provide a flow of pressurized air from the pressurized air source 12 to the vacuum responsive device 32 to release the workpiece from the vacuum responsive device 32. The vacuum responsive device 32 may include vacuum cups or any other work holding device that may operate through the use of vacuum.

Figure 2:
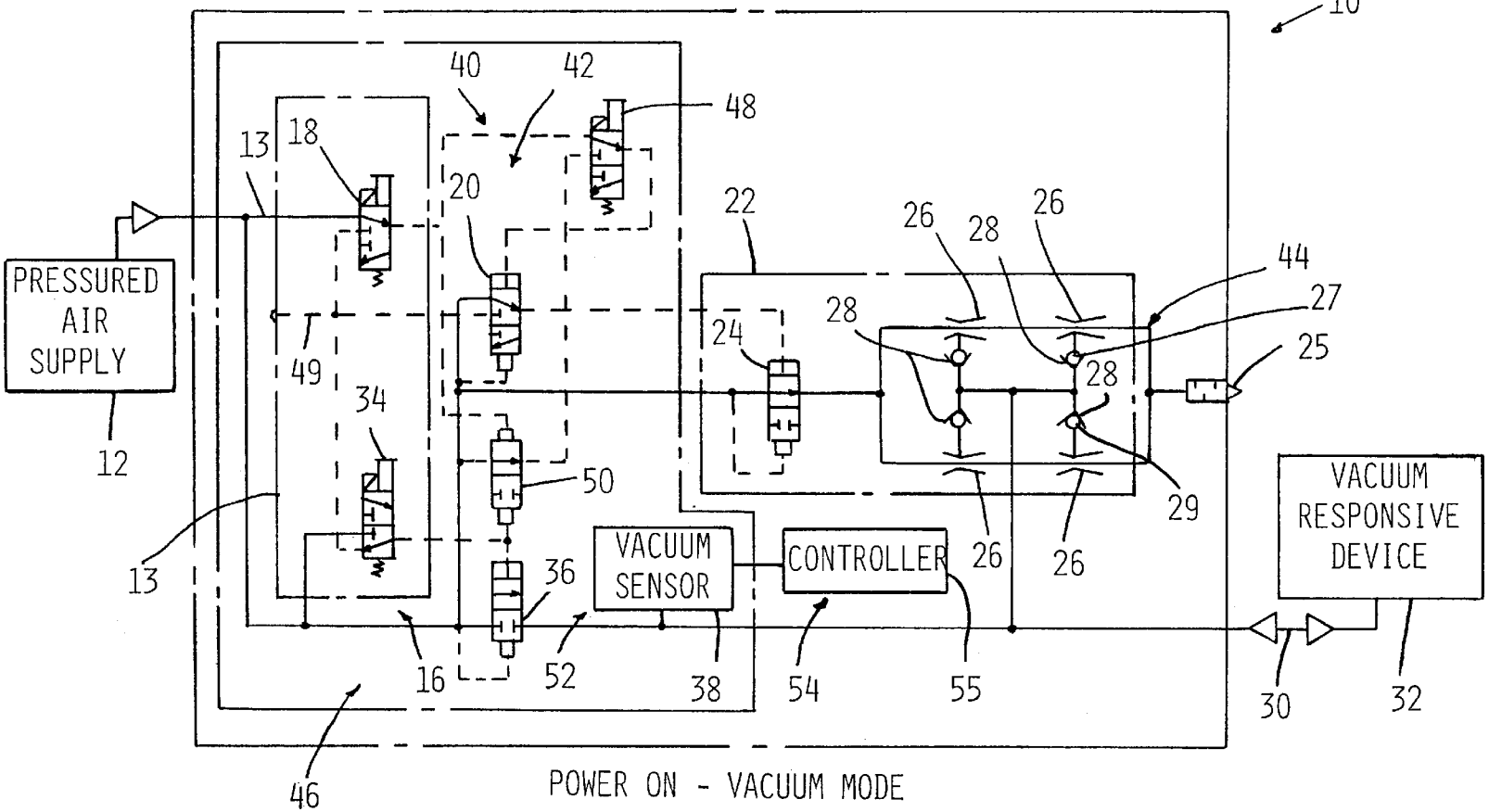
FIG. 2 is a schematic diagram of the vacuum control apparatus of the present invention shown in the power-on vacuum mode.
Figure 3:
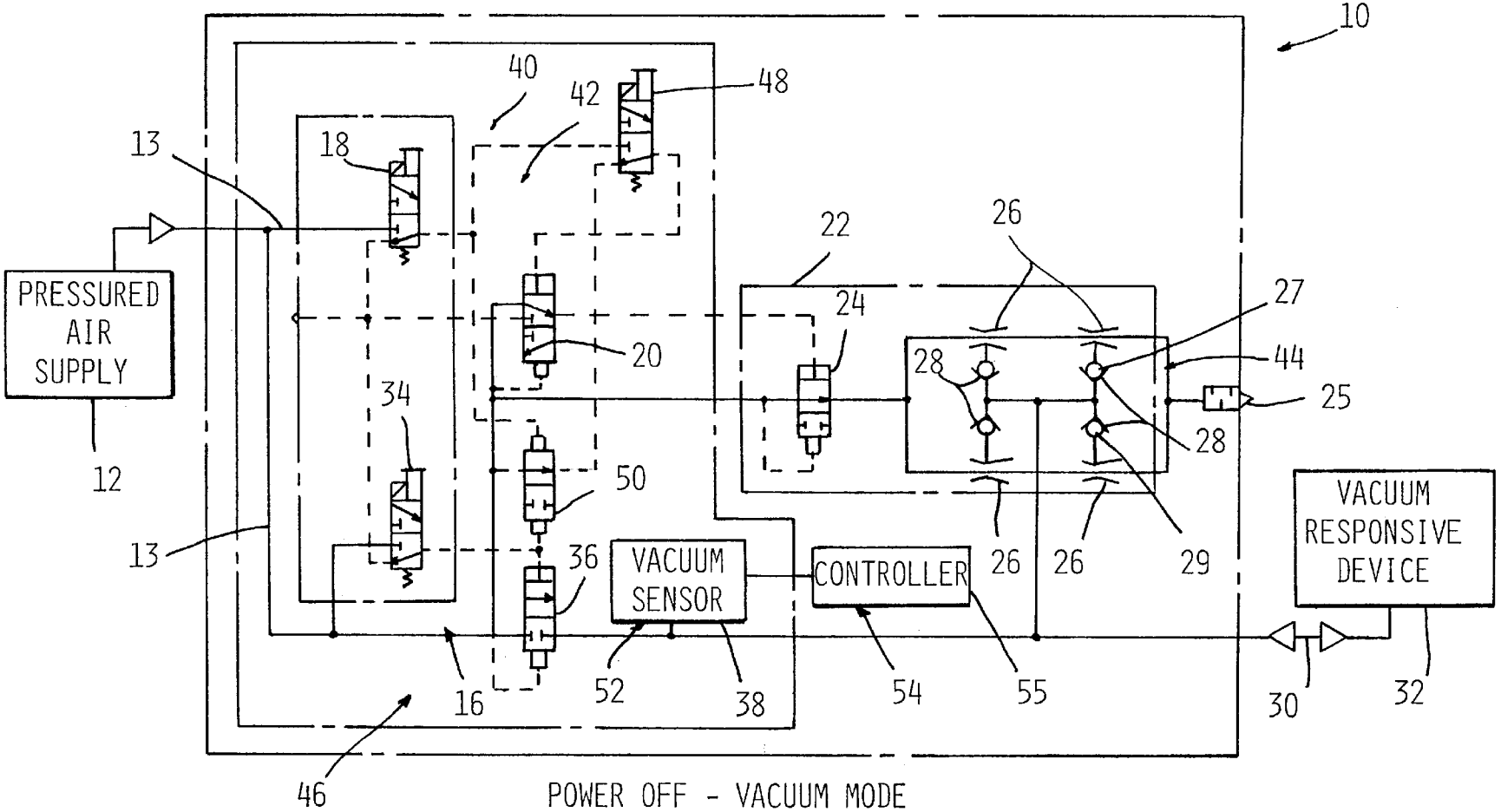
FIG. 3 is a schematic diagram of the vacuum control apparatus of the present invention shown in the power-off vacuum mode.
Figure 4:
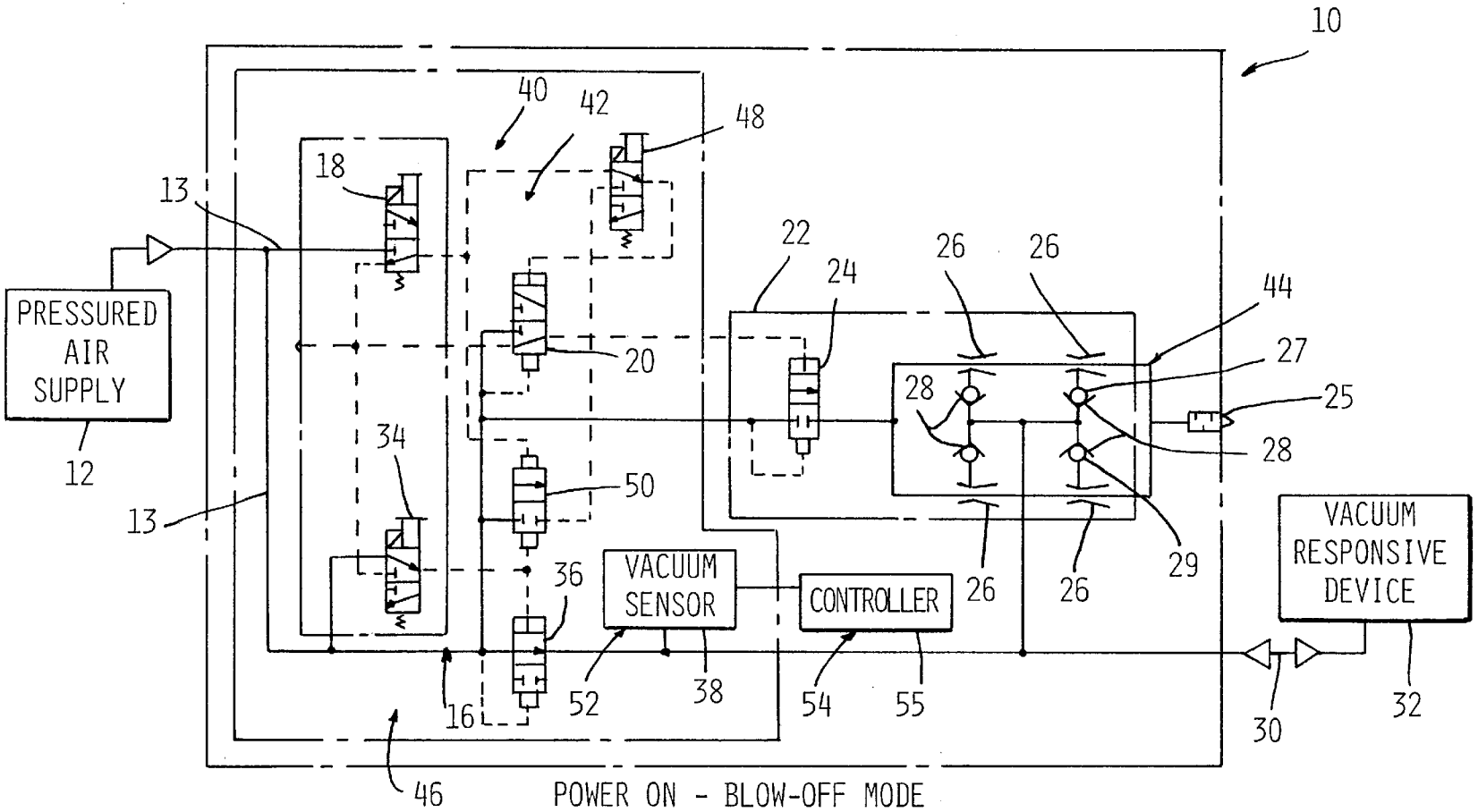
FIG. 4 is a schematic diagram of the vacuum control apparatus of the present invention shown in the power-on blow-off mode.
Figure 5:
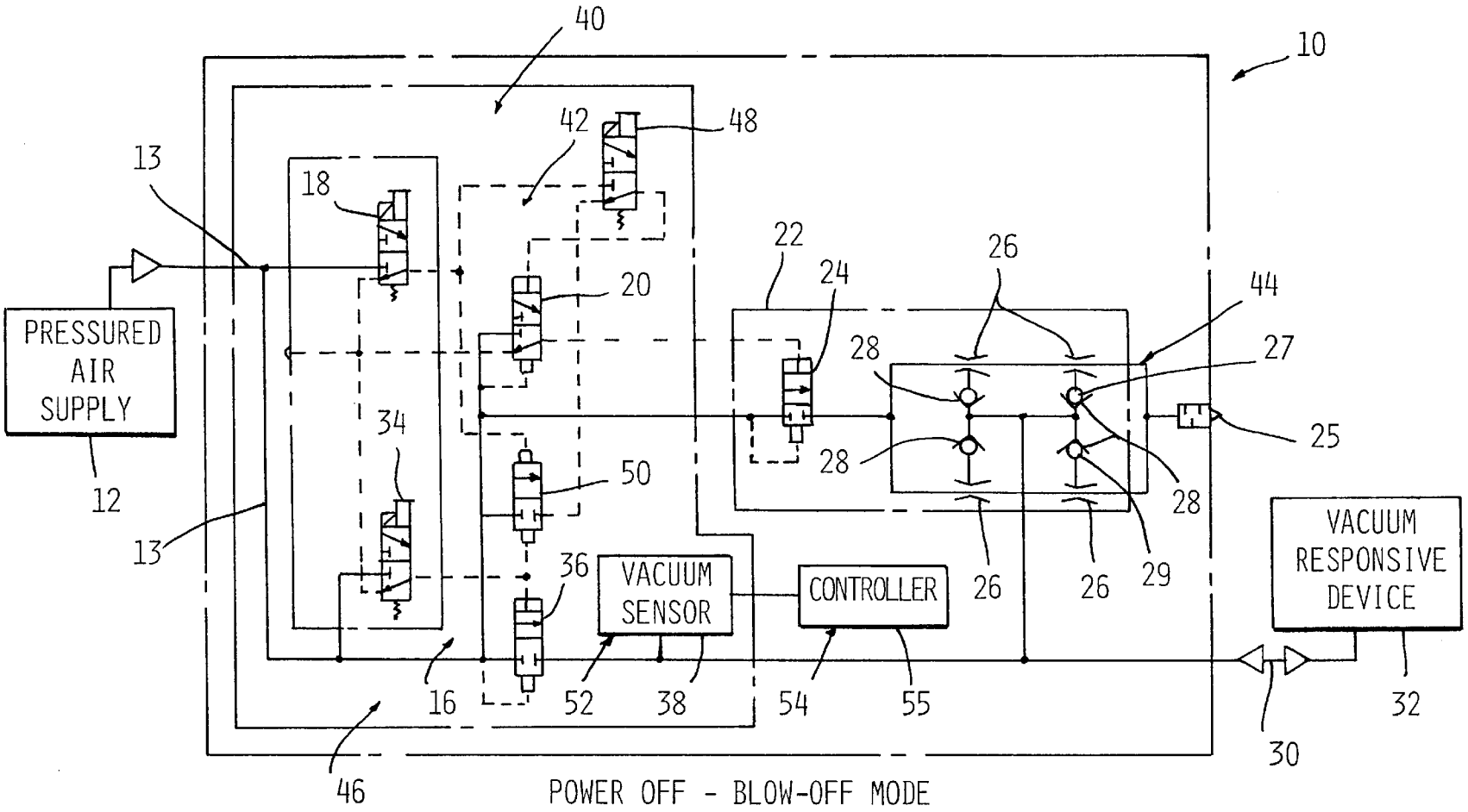
FIG. 5 is a schematic diagram of the vacuum control apparatus of the present invention shown in the power-off blow-off mode.
Figure 6:
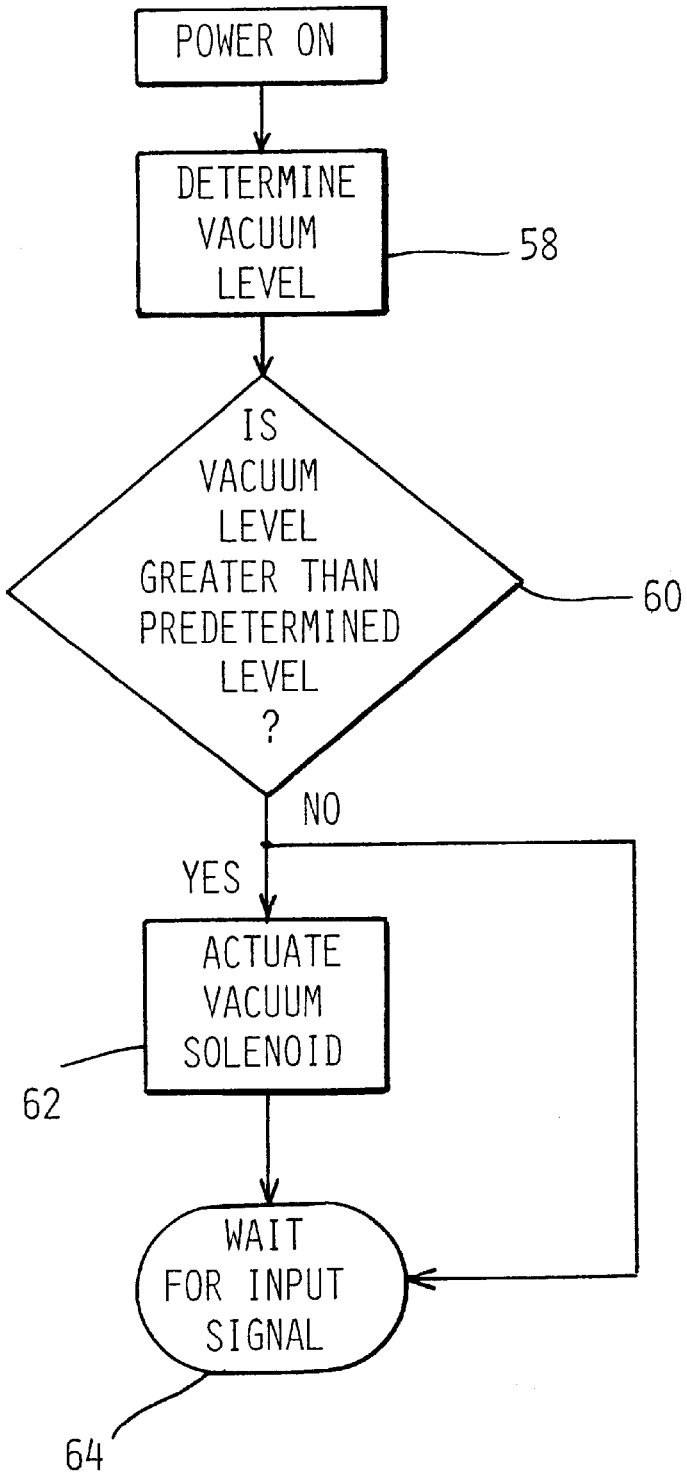
FIG. 6 is a flow diagram showing the control logic of the controller of the vacuum control apparatus of the present invention.

To selectively supply pressurized air to the vacuum creating means 44, the vacuum valve train 42 includes the vacuum solenoid operated valve 18 in communication with the pressurized air source 12. The vacuum solenoid operated valve 18 is electrically actuated between an open position (as shown in FIG. 2), wherein a flow of pressurized air from the pressurized air source 12 is allowed to flow through the vacuum solenoid operated valve 18, and a closed position (as shown in FIGS. 3–5), wherein pressurized air from the pressurized air source 12 is blocked from passing through the vacuum solenoid operated valve 18. It should be noted that the loss of electrical power to the vacuum solenoid operated valve 18 will cause deactuation of the valve 18 into the closed position.

In order to ensure that the flow of pressurized air is maintained during the loss and resumption of electrical power (as will be described in detail later), an external power solenoid operated valve 48 is placed in communication with the vacuum solenoid operated valve 18. The external power solenoid operated valve 48 is electrically actuated and maintained in a first position (as shown in FIGS. 2 and 4) as long as electrical power is being supplied to the external power solenoid operated valve 48. When the external power solenoid operated valve 48 is in the first position, pressurized air from the vacuum solenoid operated valve 18 is allowed to flow through the external power solenoid operated valve 48 (as shown in FIG. 2). When power is lost to the external power solenoid operated valve 48, the external power operated solenoid valve 48 moves to a second position thereby blocking the flow of pressurized air from the vacuum solenoid operated valve 18 (as shown in FIGS. 3 and 5.) However, when power is lost, pressurized air from the vacuum solenoid operated valve 18 no longer flows to the external power solenoid actuated valve 48 because the loss of power deactuates the vacuum solenoid operated valve 18 into its closed position.

When the external power solenoid operated valve 48 is actuated in the first position (as shown in FIGS. 2 and 4), pressurized air flows through the external power solenoid operated valve 48 to the vacuum pilot poppet valve 20. The vacuum pilot poppet valve 20 is an air actuated valve that moves between an open position and a closed position. Pressurized air from the external power solenoid operated valve 48 moves the vacuum pilot poppet valve 20 to an open position and allows for pressurized air from the pressurized air source 12 to flow through the vacuum pilot poppet valve 20. The vacuum pilot poppet valve 20 is also in communication with the pressurized air source 12 so that when pressurized air is not provided from the external power solenoid operated valve 48 to the vacuum pilot poppet valve 20, the vacuum pilot poppet valve 20 moves to a closed or second position (as shown in FIGS. 4–5). When the vacuum pilot poppet valve 20 is in its second position, the vacuum pilot poppet valve 20 is vented to atmospheric pressure 49.

The vacuum pilot poppet valve 20 is designed so that a plurality of vacuum modules 22 may be connected and controlled by a common vacuum pilot poppet valve 20. This occurs by varying the size of the orifices in the valves of the vacuum valve train 42. As seen in FIGS. 2–5, the vacuum pilot poppet valve 20 communicates with the vacuum module 22 which includes the vacuum poppet valve 24. The vacuum poppet valve 24 is an air actuated valve that selectively moves between an open position and a closed position to allow the flow of pressurized air to the vacuum creating means 44. When the vacuum poppet valve 24 receives a flow of pressurized air from the vacuum pilot poppet valve 20, the vacuum poppet valve 24 moves to an open position to allow pressurized air from the pressurized air source 12 to flow through to the vacuum creating means 44 (as shown in FIGS. 2–3). When pressurized air is not supplied from the vacuum pilot poppet valve 20 to the vacuum poppet valve 24, pressurized air from the pressurized air source 12 communicates with the vacuum poppet valve 24 to move the vacuum poppet valve 24 to the closed position and block the flow of pressurized air to the vacuum creating means 44 (as shown in FIGS. 4–5).

The vacuum creating means 44 is similar to that discussed in the prior art in that it utilizes at least one venturi 26 to generate vacuum through the flow of pressurized air. Preferably, four venturis 26 are utilized, as shown in FIGS. 2–5. Check valves 28 having the check balls or flappers 27 and valve seats 29 are utilized to prevent the flow of atmospheric pressure into the vacuum supply line when the flow of pressurized air ceases to flow through the vacuum supply line venturis 26. The vacuum that is created from the venturis 26 flows through a supply line to the vacuum port 30, and the pressurized air that flows through the venturis 26 is exhausted to the exhaust port 25.

In order to release the workpiece from the vacuum responsive device 32, the vacuum control apparatus 10 provides the second valving means 46. The second valving means 46 includes the blow-off valve train 16 which selectively provides a flow of pressurized air to the vacuum responsive device 32 so that the vacuum between the vacuum responsive device 32 and the workpiece is lost, thereby releasing the workpiece from the vacuum responsive device 32.

To selectively control the flow of pressurized air to the vacuum responsive device 32, the blow-off valve train 16 includes the blow-off solenoid operated valve 34 which is electrically actuatable between an open position and a closed position. The blow-off solenoid operated valve 34 communicates with the pressurized air source 12 such that when the blow-off solenoid operated valve 34 is electrically actuated into the open position (as shown in FIG. 4), pressurized air from the pressurized air source 12 flows through the blow-off solenoid operated valve 34. When the blow-off solenoid operated valve 34 is deactuated into the closed position (as shown in FIGS. 2, 3, and 5), pressurized air from the pressurized air source 12 is blocked from passing through the blow-off solenoid operated valve 34. Loss of electrical power to the blow-off solenoid operated valve 34 will cause the valve 34 to deactuate into the closed position.

When the blow-off solenoid operated valve 34 has been actuated to the open position, pressurized air flows through the blow-off solenoid operated valve 34 to the blow-off poppet valve 36. The blow-off poppet valve 36 is an air actuated valve that selectively directs pressurized air to the vacuum responsive device 32 by moving between an open position and a closed position. When the blow-off poppet valve 36 receives a flow of pressurized air from the blow-off solenoid operated valve 34, the flow of pressurized air moves the blow-off poppet valve 36 to an open position, wherein pressurized air from the pressurized air source 12 flows through the blow-off poppet valve 36 to the vacuum responsive device 32 (as shown in FIG. 4). When the blow-off poppet valve 36 does not receive a flow of pressurized air from the blow-off solenoid operated valve 34, pressurized air from the pressurized air source 12 moves the blow-off poppet valve 36 to a closed position to block the flow of pressurized air to the vacuum port 30 (as shown in FIGS. 2–3 and 5).

In order to maintain the operating condition of the vacuum control apparatus 10 during the loss and resumption of power to the solenoid operated valves 18, 34, 48, the vacuum control apparatus 10 provides a means for maintaining the operating condition of the vacuum responsive device 32 created by the selective positioning of the first and second valving means 40, 46. The operating condition maintaining means includes a last function valve 50 that communicates with the vacuum valve train 42, the blow-off valve train 16, and the pressurized air source 12. The last function valve 50 is an air actuated valve that selectively controls the flow of pressurized air to the vacuum creating means 44 by moving between an open position and a closed position. The last function valve 50 communicates with the vacuum solenoid operated valve 18 such that when the last function valve 50 receives the flow of pressurized air from the vacuum solenoid operated valve 18, the last function valve 50 moves to the open position to allow for pressurized air from the pressurized air source 12 to flow to the external power solenoid operated valve 48 (as shown in FIGS. 2–3). The last function valve 50 is also in communication with the blow-off solenoid operated valve 34 such that when the blow-off solenoid operated valve 34 is actuated in the open position to communicate pressurized air to the last function valve 50, the last function valve 50 moves to the closed position, wherein the flow of pressurized air is blocked from passing through the last function valve 50 (as shown in FIGS. 4–5). It should be noted that the vacuum solenoid operated valve 18 and the blow-off solenoid operated valve 34 are held in communication such that only one of these solenoid operated valves 18, 34 may be actuated in the open position at the same time.

To move the vacuum control apparatus 10 back into its original operating condition after the loss and resumption of power, the vacuum control apparatus 10 provides a vacuum sensing means 52 and a means for controlling 54 the first and second valving means (as shown in FIGS. 2–5). The vacuum sensing means 52 provides a vacuum sensor 38 that communicates with the vacuum port 30 and the vacuum creating means 44, and the controlling means 54 provides a controller 55 for actuating the solenoid operated valves 18, 34. As seen in block 58 of FIG. 6, the vacuum sensor 38 indicates the level of vacuum being provided to the vacuum port 30. After the resumption of power to the solenoid operated valves 18, 34, 48, the vacuum sensor 38 sends a signal to the controller 55 indicating the level of vacuum at the vacuum port 30. The controller 55 provides software within the vacuum control apparatus 10 which interprets whether the level of vacuum at the vacuum port 30 is above or below a level of vacuum which is maintained when engaging and holding a workpiece by the vacuum responsive device 32, as shown in decision block 60 of FIG. 6. If the level of vacuum is above this predetermined level, then the controller 55 actuates the vacuum solenoid operated valve 18 into the open position so that the original pneumatic circuitry, established prior to the loss of power, is reestablished, as shown in Block 62 of FIG. 6. If the vacuum level is below the predetermined level, then the controller 55 interprets the signal as meaning that no part is engaged by the vacuum responsive device 32, and therefore, the controller 55 remains idle until an input signal is provided to the vacuum control apparatus 10, as shown in block 64 of FIG. 6.

In operation, the vacuum control apparatus 10 may start in a vacuum mode with electric power on, as shown in FIG. 2. The vacuum solenoid operated valve 18 is electrically actuated to an open position wherein pressurized air from the pressurized air source 12 passes through the vacuum solenoid operated valve 18. Pressurized air is then directed to and through the open actuated external power solenoid operated valve 48 to the open vacuum pilot poppet valve 20. Pressurized air from the pressurized air source 12 flows through the vacuum pilot poppet valve 20 to the open vacuum poppet valve 24, wherein pressurized air flows across the venturis 26 to produce vacuum to the vacuum port 30. A flow of pressurized air also flows from the vacuum solenoid operated valve 18 to the last function valve 50. The last function valve 50 opens and allows pressurized air to flow to a closed port of the external power solenoid operated valve 48. It should be noted that when the vacuum solenoid operated valve 18 is actuated, the blow-off solenoid operated valve 34 is deactuated in the closed position.

When electrical power is lost to the solenoid operated valves 18, 34, 48 while in the vacuum mode, the vacuum control apparatus 10 reflects the pneumatic circuitry shown in FIG. 3. Pressurized air from the pressurized air source 12 is blocked by the vacuum solenoid operated valve 18 as the loss of power causes the vacuum solenoid operated valve 18 to deactuate into the closed position. The external power solenoid operated valve 48 is also deactuated into its second position. The second position of the external power solenoid operated valve 48 allows for the flow of pressurized air from the last function valve 50 to flow through the external power solenoid operated valve 48 to the vacuum pilot poppet valve 20. The flow of pressurized air maintains the vacuum pilot poppet valve 20 in the open position so that pressurized air from the pressurized air source 12 continues to flow to the vacuum poppet valve 24. The vacuum poppet valve 24 is maintained in the open position, and pressurized air from the pressurized air source 12 continues to flow to the venturis 26 so as to generate vacuum to the vacuum responsive device 32.

FIG. 4 shows the vacuum control apparatus 10 in a blow-off mode with the electrical power on. The blow-off solenoid operated valve 34 is actuated in its open position wherein pressurized air from the pressurized air source 12 flows through the blow-off solenoid operated valve 34. The pressurized air flows to the blow-off poppet valve 36 wherein the blow-off poppet valve 36 moves to its open position. Pressurized air from the pressurized air source 12 flows through the blow-off poppet valve 36 to the vacuum responsive device 32. In addition, pressurized air from the blow-off solenoid operated valve 34 flows to the last function valve 50 and moves the last function valve 50 to the closed position. This prevents the flow of pressurized air through the last function valve 50 to the external power solenoid operated valve 48. It should also be noted that when the blow-off solenoid operated valve 34 is actuated, the vacuum solenoid operated valve 18 must be deactuated in the blow-off mode thereby preventing the flow of pressurized air through the vacuum solenoid operated valve 18.

FIG. 5 shows the vacuum control apparatus 10 in a blow-off mode with the electrical power off. The blow-off solenoid operated valve 34 is deactuated into the closed position thereby blocking the flow of pressurized air through the blow-off solenoid operated valve 34. Since there is no flow of pressurized air from the blow-off solenoid operated valve 34 to the blow-off poppet valve 36, the flow of pressurized air from the pressurized air source 12 moves the blow-off poppet valve 36 to the closed position, thus preventing the flow of pressurized air to the vacuum responsive device 32. Since there is no flow of pressurized air from either the blow-off solenoid operated valve 34 or the vacuum solenoid operated valve 18 to the last function valve 50, the last function valve 50 remains in the closed position and prevents the flow of pressurized air to the external power solenoid operated valve 48.

Although pressurized air is provided to the vacuum responsive device 32 in the blow-off mode prior to the loss of power, there is no need for the pressurized air to resume flowing to the vacuum responsive device 32 when the power is restored since the workpiece would have already been released from the vacuum responsive device 32 upon being actuated in the blow-off mode. This conserves pressurized air from needlessly flowing through the vacuum responsive device 32 when the workpiece has already been released from the vacuum responsive device 32.

After the loss and resumption of power to the vacuum control apparatus 10, the vacuum sensor 38 senses the level of vacuum being supplied to the vacuum responsive device 32. The vacuum sensor 38 sends a signal to the controller 55 indicating the level of vacuum being supplied to the vacuum responsive device 32. If the level of vacuum is above the predetermined level, which indicates that a workpiece is being held by the vacuum responsive device 32, then the vacuum mode is on, and the controller 55 actuates the vacuum solenoid operated valve 18 to the open position to reflect the diagram shown in FIG. 2. If the level of vacuum is be low the predetermined level, then the workpiece is not engaged by the vacuum responsive device 32, and the vacuum control apparatus 10 is in the blow-off mode. The controller 55 does not actuate the blow-off solenoid operated valve 34 because the workpiece has already been released from the vacuum responsive device 32. At this point, the controller 55 remains idle, and the vacuum control apparatus 10 stands ready for an input.

While the invention has been described in connection with what is presently considered to be the most practical and preferred embodiment, it is to be understood that the invention is not to be limited to the disclosed embodiments, but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A vacuum control apparatus for generating and controlling a source of vacuum produced from a source of pressurized air in communication with at least one vacuum responsive device, the vacuum control apparatus comprising:

means, communicatable with said vacuum responsive device, for creating vacuum through a flow of pressurized air and communicating said vacuum to said vacuum responsive device;

first valving means, communicatable with said pressurized air source, for selectively providing a flow of pressurized air from said pressurized air source to said vacuum creating means;

second valving means, communicatable with said pressurized air source, for selectively providing a flow of pressurized air from said pressurized air source to said vacuum responsive device; and means, in communication with said first and second valving means and communicatable with said pressurized air source, for maintaining the operational condition created by the selective positioning of said first and second valving means during the loss and resumption of power to said first and second valving means.

2. The vacuum control apparatus as stated in claim 1, wherein said vacuum creating means further comprises:

at least one venturi for generating sub-atmospheric pressure in response to a flow of pressurized air.

3. The vacuum control apparatus as stated in claim 1, wherein said first valving means further comprises:

a first solenoid operated valve communicatable with said pressurized air source and actuatable between an open position, wherein pressurized air flows through said first solenoid operated valve from said pressurized air source, and a closed position, wherein pressurized air is blocked from flowing through said first solenoid operated valve;

a second solenoid operated valve in communication with said first solenoid operated valve and actuatable between a first position, wherein pressurized air from said vacuum solenoid operated valve flows through said second solenoid operated valve, and a second position, wherein pressurized air from said first solenoid operated valve is blocked from passing through said second solenoid operated valve; and a first air operated valve in communication with said second solenoid operated valve and said vacuum creating means, and said first air operated valve movable between an open position, wherein pressurized air from said second solenoid operated valve moves said first air operated valve to an open position to allow pressurized air from said pressurized air source to flow to said vacuum creating means, and a closed position, wherein pressurized air is blocked from passing through said first air operated valve to said vacuum creating means.

4. The vacuum control apparatus as stated in claim 1, wherein said second valving means further comprises:

a solenoid operated valve communicatable with said pressurized air source and actuatable between an open position, wherein pressurized air flows through said solenoid operated valve from said pressurized air source, and a closed position, wherein pressurized air is blocked from passing through said solenoid operated valve; and an air operated valve in communication with said solenoid operated valve and communicatable with said vacuum responsive device, and said air operated valve movable between an open position, wherein pressurized air flows from said solenoid operated valve to move said air operated valve to said open position to allow pressurized air from said pressurized air source to flow to said vacuum responsive device, and a closed position, wherein pressurized air from said pressurized air source moves said air operated valve to a closed position to block pressurized air from passing through said air operated valve to said vacuum responsive device.

5. The vacuum control apparatus as stated in claim 1, wherein said maintaining means further comprises:

an air operated valve in communication with said first valving means, and said air operated salve movable between an open position, wherein pressurized air from said pressurized air source flows through said air operated valve to said vacuum responsive device, and a closed position, wherein pressurized air from said pressed air source is blocked from passing through said air operated valve;

said first valving means selectively providing a flow of pressurized air to said air operated valve to move said or operated valve to said open position; and said pressurized air source providing a flow of pressurized air to said air operated valve to move said air operated valve to said closed position when said first valving means is not providing pressurized air to said air operated valve.

6. The vacuum control apparatus as stated in claim 1, further comprising:

means, in communication with said vacuum creating means and said vacuum responsive device, for sensing vacuum.

7. The vacuum control apparatus as stated in claim 6, further comprising:

means for controlling said first and second valving means wherein said vacuum sensing means determines the level of vacuum after the loss and resumption of power to said first and second valving means, and if said vacuum level is above a predetermined level, then said controlling means actuates said first valving means, and if said vacuum level is below a predetermined level, then said controlling means remains idle.

8. A vacuum control apparatus for generating and controlling a source of vacuum produced from a source of pressurized air in communication with at least one vacuum responsive device, the vacuum control apparatus comprising:

at least one venturi for generating sub-atmospheric pressure in response to a flow of pressurized air and communicated to said vacuum responsive device;

a first valve train, communicatable with said pressurized air source, for selectively providing a flow of pressurized air to said venturi;

a second valve train, communicatable with said pressurized air source, for selectively providing a flow of pressurized air to said vacuum responsive device; and a last function valve in communication with said first and second valve train and communicatable with said pressurized air source, and said last function valve selectively providing a flow of pressurized air to maintain the same operating condition as said first and second valve train prior to a loss of power so that said operating condition is maintained during the loss and resumption of power to said first and second valve train.

9. The vacuum control apparatus as stated in claim 8, wherein said first valve train comprises:

a vacuum solenoid operated valve communicatable with said pressurized air source and actuatable between an open position, wherein a flow of pressurized air passes through said vacuum solenoid operated valve from said pressurized air source, and a closed position, wherein said flow of pressurized air from said pressurized air source is prevented from passing through said vacuum solenoid operated valve;

an external power solenoid operated valve in communication with said vacuum solenoid operated valve and actuatable between a first position, wherein pressurized air from said vacuum solenoid operated valve is allowed to flow through said external power solenoid operated valve, and a second position, wherein pressurized air from said vacuum solenoid operated valve is not allowed to pass through said external power solenoid operated valve; and a vacuum pilot valve in communication with said external power solenoid operated valve and communicatable with said pressurized air source, and said vacuum pilot valve movable between a first position, wherein a flow of pressurized air from said external power solenoid operated valve moves said vacuum pilot valve to an open position and pressurized air from said pressurized air source flows through said vacuum pilot valve to said venturi, and a second position, wherein said pressurized air source moves said vacuum pilot valve to said second position and atmospheric pressure is vented through said vacuum pilot valve.

10. The vacuum control apparatus as stated in claim 9, further comprising:

a vacuum valve in communication with said vacuum pilot valve and communicatable with said pressurized air source, and said vacuum valve movable between an open position, wherein a flow of pressurized air from said vacuum pilot valve moves said vacuum valve to said open position and pressurized air from said pressurized air source flows through said vacuum valve to said venturi, and a closed position, wherein a flow of pressurized air from said pressurized air source moves said vacuum valve to a closed position and pressurized air from said pressurized air source is blocked from passing through said vacuum valve.

11. The vacuum control apparatus as stated in claim 8, further comprising:

a vacuum sensor in communication with said venturi and communicatable with said vacuum responsive device to determine the level of vacuum being applied to said vacuum responsive device.

12. The vacuum control apparatus as stated in claim 11, further comprising:

a controller for reading the level of vacuum determined by said vacuum sensor after the loss and resumption of power to said first and second valve train, and if the level of vacuum is above a predetermined level, then said controller actuates said first valve train, and if the level of vacuum is below a predetermined level, then said controller remains idle.

13. The vacuum control apparatus as stated in claim 8, wherein said second valve train comprises:

a blow-off solenoid operated valve communicatable with said pressurized air source and actuatable between an open position, wherein pressurized air from said pressurized air source flows through said blow-off solenoid operated valve, and a closed position, wherein pressurized air is blocked from passing through said blow-off solenoid operated valve; and a blow-off valve in communication with said blow-off solenoid operated valve and communicatable with said vacuum responsive device, and said blow-off valve movable between an open position, wherein a flow of pressurized air from said blow-off solenoid operated valve moves said blow-off valve to said open position and pressurized air from said pressurized air source flows through said blow-off valve to said vacuum responsive device, and a closed position, wherein a flow of pressurized air from said pressurized air source moves said blow-off valve to said closed position to block pressurized air from passing through said blow-off valve.

14. The vacuum control apparatus as stated in claim 8, wherein said last function valve further comprises:

said last function valve movable between an open position, wherein a flow of pressurized air from said first valve train moves said last function valve to said open position and allows pressurized air from said pressurized air source to flow through said last function valve to said venturi, and a closed position, wherein a flow of pressurized air from said second valve train moves said last function valve to said closed position to block pressurized air from passing through said last function valve.

15. A vacuum control apparatus for generating and controlling a source of vacuum produced from a source of pressurized air in communication with at least one vacuum responsive device, the vacuum control apparatus comprising:

at least one venturi for generating sub-atmospheric pressure in response to a flow of pressurized air to said vacuum responsive device;

a vacuum pilot poppet valve in communication with said venturi and communicatable with said pressurized air source, and said vacuum pilot poppet valve movable between an open position, wherein pressurized air flows from said pressurized air source to said venturi, and a closed position, wherein said pressurized air is blocked from passing through said vacuum pilot poppet valve;

an external power solenoid operated valve in communication with said vacuum pilot poppet valve, wherein pressurized air flows through said external power solenoid operated valve to move said vacuum pilot poppet valve to said open position;

a vacuum solenoid operated valve in communication with said external power solenoid operated valve and communicatable with said pressurized air source, and said vacuum solenoid operated valve actuatable between an open position, wherein pressurized air from said pressurized air source flows through said vacuum solenoid operated valve to said external power solenoid operated valve, and a closed position, wherein pressurized air is blocked from passing through said vacuum solenoid operated valve;

a blow-off poppet valve in communication with said vacuum responsive device and communicatable with said pressurized air source, and said blow-off poppet valve movable between an open position, wherein pressurized air from said pressurized air source flows to said vacuum responsive device, and a closed position, wherein pressurized air is blocked from flowing through said blow-off poppet valve to said vacuum responsive device;

a blow-off solenoid operated valve in communication with said blow-off poppet valve and communicatable with said pressurized air source, and said blow-off solenoid operated valve actuatable between a first position, wherein pressurized air from said pressurized air source moves said blow-off poppet valve to said open position, and a second position, wherein pressurized air is blocked from flowing through said blow-off solenoid operated valve;

a last function valve in communication with said vacuum solenoid operated valve and said blow-off solenoid operated valve and communicatable with said pressurized air source, and said last function valve movable between an open position, wherein pressurized air from said vacuum solenoid operated valve moves said last function valve to said open position to allow pressurized air to flow to said external power solenoid operated valve, and a closed position, wherein pressurized air from said blow-off solenoid operated valve moves said last function valve to said closed position to prohibit the flow of pressurized air to said vacuum responsive device during the loss and resumption of power to said solenoid operated valves; and said external power solenoid operated valve actuatable between an actuated position, wherein said external power solenoid directs pressurized air from said vacuum solenoid operated valve to said vacuum pilot poppet valve, and a deactuated position, wherein said external power solenoid operated valve directs pressurized air from said last function valve to said vacuum pilot poppet valve to maintain vacuum to said vacuum responsive device during the loss and resumption of power to said solenoid operated valves.

16. The vacuum control apparatus as stated in claim 15, further comprising:

at least one vacuum poppet valve in communication with said vacuum pilot poppet valve and said venturi and communicatable with said pressurized air source, and said vacuum poppet valve movable between an open position, wherein pressurized air from said vacuum pilot poppet valve moves said vacuum poppet valve to said open position to allow pressurized air from said pressurized air source to flow to said venturi, and a closed position, wherein pressurized air from said pressurized air source moves said vacuum poppet valve to said closed position to prevent pressurized air from flowing to said venturi.

17. The vacuum control apparatus stated in claim 15, further comprising:

a vacuum sensor in communication with said venturi and communicatable with said vacuum responsive device to determine the level of vacuum being applied to said vacuum responsive device.

18. The vacuum control apparatus stated in claim 17, further comprising:

a controller for reading the level of vacuum determined by said vacuum sensor, and if after the loss and resumption of power, the level of vacuum is above a predetermined level, then said controller actuates said vacuum solenoid, and if the level of vacuum is below a predetermined level, then said controller remains idle.

* * * * *